United States Patent [19]

Coleman et al.

[11] Patent Number: 4,972,956

[45] Date of Patent: Nov. 27, 1990

[54] METHOD OF REMOVING CARBONACEOUS PARTICLES, ESSENTIALLY FREE OF PYRITIC SULPHUR, FROM AN AQUEOUS COAL SLURRY

[75] Inventors: Richard D. Coleman; Serge Croteau, both of Orleans; Charles E. Capes, Ottawa, all of Canada

[73] Assignee: National Research Council of Canada, Ottawa, Canada

[21] Appl. No.: 326,362

[22] Filed: Mar. 21, 1989

Related U.S. Application Data

[63] Continuation-in-part of Ser. No. 115,418, Nov. 2, 1987, abandoned.

[51] Int. Cl.[5] ..... B03D 1/02; B03D 1/10

[52] U.S. Cl. ..... 209/5; 209/166

[58] Field of Search ..... 209/166, 167, 5

[56] References Cited

U.S. PATENT DOCUMENTS

| | | | |
|---|---|---|---|
| 4,249,910 | 2/1981 | Masologites | 209/166 |
| 4,272,250 | 6/1981 | Burk | 209/166 |
| 4,564,369 | 1/1986 | Burgess | 209/166 |
| 4,593,859 | 6/1986 | Nakaoji | 209/166 |

FOREIGN PATENT DOCUMENTS

| | | | |
|---|---|---|---|
| 204462 | 12/1986 | European Pat. Off. | 209/166 |
| 2143155 | 2/1985 | United Kingdom | 209/166 |
| 2164271 | 3/1986 | United Kingdom | 209/166 |
| 2166156 | 4/1986 | United Kingdom | 209/166 |

*Primary Examiner*—David L. Lacey
*Assistant Examiner*—Thomas M. Lithgow
*Attorney, Agent, or Firm*—Griffin Branigan & Butler

[57] ABSTRACT

Carbonaceous coal particles, essentially free of pyritic sulphur, are removed from an aqueous coal slurry in two steps. In the first step the carbonaceous particles of the slurry, with the pyritic sulphur essentially free of surface conditioning agent, are micro-agglomerated with agglomerating oil added in an amount varying from about 0.5 wt % (dry basis), when the coal particle average size is about 100 microns, to about 10 wt % (dry basis) when the average coal particle size is about 4 microns to remove relatively coarser particles of pyritic sulphur. Then, without adding any further agglomerating oil, relatively finer pyritic sulphur particles trapped with water in the micro-agglomerates are removed.

3 Claims, 3 Drawing Sheets

Figure 1:
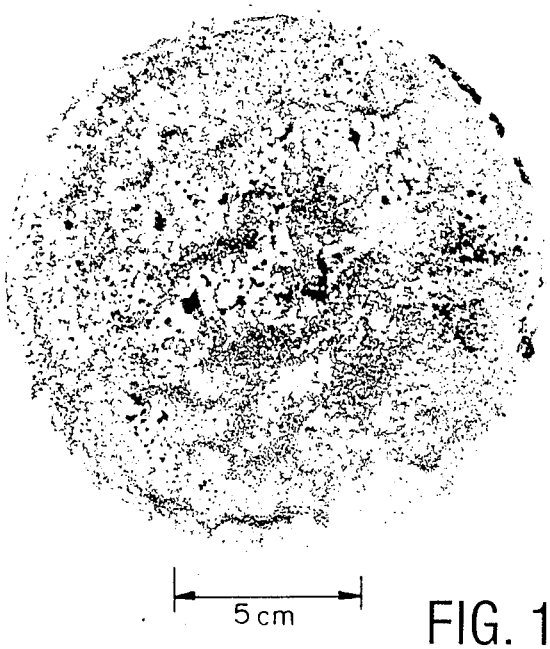

METHOD OF REMOVING CARBONACEOUS PARTICLES, ESSENTIALLY FREE OF PYRITIC SULPHUR, FROM AN AQUEOUS COAL SLURRY

This application is a continuation-in-part application of copending application Ser. No. 07/115,418, filed Nov. 2, 1987, (now abandoned) which is specifically incorporated herein by reference. This invention relates to a method of removing carbonaceous particles, essentially free of pyritic sulphur, from an aqueous coal slurry.

It has already been proposed in U.S. Pat. No. 4,284,413, dated Aug. 18, 1981, "In-Line Method for the Beneficiation of Coal and the Formation of A Coal-In-Oil Combustible Fuel Therefrom", C.E. Capes et al, to provide an in-line method for the beneficiation of coal and the formulation of a coal-in-oil combustible fuel wherein the coal is wet pulverized, micro-agglomerated with light oil to dissociate a large amount of inorganic impurities and some water, agglomerated with heavy oil to form relatively larger agglomerates and dissociate mainly water with some inorganic impurities, and then mixed with further heavy oil to form the coal-in-oil combustible fuel.

It has already been proposed in U.S. Pat. No. 3,655,066, dated May 23, 1972, "Beneficiation of Coals", C.E. Capes et al, to add a bridging liquid to an aqueous, clay containing slurry of coal fines, then agitate the resultant mixture to form coal agglomerates dispersed in a slurry of the residual clay and ash impurities, and then separate the coal agglomerates by skimming them through an overflow spout in a float-sink tank. The separation of the coal agglomerates may be assisted by introducing a multitude of air bubbles at the bottom of the float sink tank.

It has also been proposed in British Patent Application No. 2,143,155A, published Feb. 6, 1985, "A Method of Separating Fine Coal Particles from Refuse", G.A. Wasson et al, to separate fine coal particles from refuse by mixing oil and water with a coal-refuse solids mixture at high shear agitation conditions, to form a floccular mixture comprising flocs of oil and fine coal particles and unflocculated refuse in water, floating the flocs in a flotation means, and separating the flocs of oil and coal particles from a substantial portion of the water.

It has also been proposed in U.S. Pat. No. 4,272,250, dated June 9, 1981, "Process for Removal of Sulphur and Ash from Coal", E.H. Burk, Jr., to reduce the sulphur and ash content of coal particles by adding a minor amount of hydrocarbon oil to an aqueous slurry of the coal particles to effect aggregation of the coal particles into coal-oil aggregates (flocs) with gas (air) incorporated into or on the aggregates to modify their density, then gravitationally separating the aggregates and recovering them with a reduced sulphur content. The aggregation and the incorporation of air may be effected simultaneously, and a partial separation of the density modified coal/oil aggregates from the slurry, as by skimming, screening may be effected (column 11, lines 10–18) but further processing (centrifugal separation) is customarily required to recover the carbon heating values. The resulting coal product can exhibit a diminished non-pyritic sulphur content: for example, in some coals up to 30% by weight of non-pyritic sulphur may be removed. Additionally, reduction in ash content is typically from about 20 to 80 wt %, or even higher, and pyritic sulphur reduction is typically from about 40 to 90 wt % or even higher.

Burk, Jr., et al., column 12, lines 65–68, teaches that the recovered coal particles may be subjected to further treatment. The only treatment of the coal-oil flocs taught by Burk, Jr., et al is by washing them with a light oil, see column 12, lines 56–59, and this will produce a coal-oil slurry containing any impurities present in the flocs.

While the process of E.H. Burk, Jr., et al has proved to be useful, a problem still exists in that pyritic sulphur particles present in the coal slurry also absorb agglomerating oil and tend to be agglomerated or flocculated with the carbonaceous particles of the coal, and so are difficult to separate, see for example, "Coal Desulphurization", ACS Symposium Series 64, American Chemical Society, 1977.

U.S. Pat. No. 4,249,910, dated Feb. 10, 1981, "Process For Removing Sulphur From Coal", G.E. Masologites et al, teaches first adding a conditioning agent, e.g. metal oxides and hydroxides, metal aluminates, aluminasilicates, metal silicates and inorganic cement materials to alter or modify the surface characteristics of the pyritic sulphur to render the pyritic sulphur more amenable to separation from the coal particles on agglomeration of the coal particles.

While the process of Masologites et al is useful, at least the conditioning agents proposed which could be used on a commercial scale would lower the fusion temperature of any slag formed in burning the agglomerated coal and so the slag would more readily stick to heat transfer surfaces in a combustion chamber. Coal as mined already contains minor amounts of such contaminants and adding further amounts of them can only worsen any undesirable effects that they have.

Applicants have found that, (i) no conditioning agent is necessary and a dramatically much better sulphur reduction is obtained if micro-agglomerates are formed using an amount of agglomerating oil dependent on the average particle size of the coal particles, the micro-agglomerates are then aerated to render them buoyant and the aerated micro-agglomerates are then skimmed from the other slurry components, and (ii) even with step (i) there is undesirably large carry over of relatively fine pyritic sulphur particles that are trapped in water in the micro-agglomerates and so, with no further addition of agglomerating oil, it has been found that a further dramatic reduction of the pyritic sulphur content can be obtained if the water containing the relatively fine pyritic sulphur particles is removed from the skimmed micro-agglomerates.

According to the present invention there is provided a method of removing carbonaceous particles, essentially free of pyritic sulphur, from an aqueous coal slurry, comprising:

(a) violently mixing an agglomerating oil with the coal slurry, the coal slurry comprising discrete carbonaceous coal particles, surface conditioning agent additive free discrete particles of pyritic sulphur, discrete particles of any other inorganic substances present, and water, the agglomerating oil being mixed in an amount varying from 0.5 wt % (dry basis), when the coal particles have an average particle size of about 100 microns, to about 10 wt % (dry basis), when the coal particles have an average particle size of about 4 microns, so that only sufficient agglomerating oil is present to preferentially oil wet substantially all of the carbonaceous coal particles, leaving substantially all of the particles of pyritic sulphur unwetted by the agglomerating oil, then (b) continuing the violent mixing until open structured, chain-like micro-agglomerates are formed, in a major portion of the water, comprising essentially oil wetted carbonaceous coal particles, with trapped water in the micro-agglomerates, the trapped water containing minor amounts of the particulate pyritic sulphur and other inorganic substances in finely divided form, with major amounts of the particulate pyritic sulphur and other inorganic substances remaining as individual particles in the major portion of the water in a relatively coarser form, then (c) aerating the slurry to render the micro-agglomerates buoyant in the major portion of the water, then (d) separating the buoyant micro-agglomerates from the major portion of the water, then, without any additional agglomerating oil being present, (e) removing trapped water, containing minor amounts of pyritic sulphur and other inorganic substances, from the micro-agglomerates.

In some embodiments of the present invention the trapped water, containing minor amounts of pyritic sulphur and other inorganic solids, is removed from the micro-agglomerates by (f) mixing washing water with the micro-agglomerates until (i) the micro-agglomerates are broken down to disperse the oil wetted carbonaceous coal particles and release the trapped water containing minor amounts of particulate pyritic sulphur and other inorganic substances into the washing water, and (ii) the oil wetted carbonaceous coal particles are formed into fresh micro-agglomerates with previously trapped water containing minor amounts of particulate pyritic sulphur and other inorganic substances remaining in the washing water, then (g) aerating the washing water to render the fresh micro-agglomerates buoyant, and then (h) separating the fresh micro-agglomerates from the washing water.

In other embodiments of the present invention, without any additional agglomerating oil being present, steps (f) to (h) are repeated at least once more in fresh washing water to form fresh micro-agglomerates separated from the fresh washing water and newly released, previously trapped pyritic sulphur and any other inorganic substances dispersed in the washing water.

After step (h) the fresh micro-agglomerates may be broken down and contacted with further agglomerating oil to release water from them, the oil wetted carbonaceous coal particles are then agitated to form relatively larger agglomerates with the further agglomerating oil without released water being present in the relatively larger agglomerates.

In this patent specification, liberated carbonaceous particles of the coal includes wholly carbonaceous particles, and carbonaceous particles containing some inorganic substances.

A frothing agent may be added to the slurry, in an amount in the range of about 0.0025 to 0.05 wt % of the total weight of the solids content of the slurry, before the micro-agglomerates are formed.

If the amount of agglomerating oil added is less than about 1 wt %, then the frothing agent may be added to the slurry, in an amount in the range of about 0.0025 to 0.05 wt %, based on the total weight of the solids content of the slurry.

In some embodiments of the present invention the violent mixing is carried out in at least one high shear mixer, and the trapped water containing minor amounts of pyritic sulphur and other inorganic solids is removed from the micro-agglomerates by centrifugal separation.

In other embodiments of the present invention the violent mixing is carried out in at least one high shear mixer, and the open-structured, chain-like micro-agglomerates are broken down in washing water and reformed into open-structured, chain-like micro-agglomerates in at least one relatively low shear mixer to separate the trapped water containing the minor amounts of pyritic sulphur and other inorganic solids.

Figure 2:
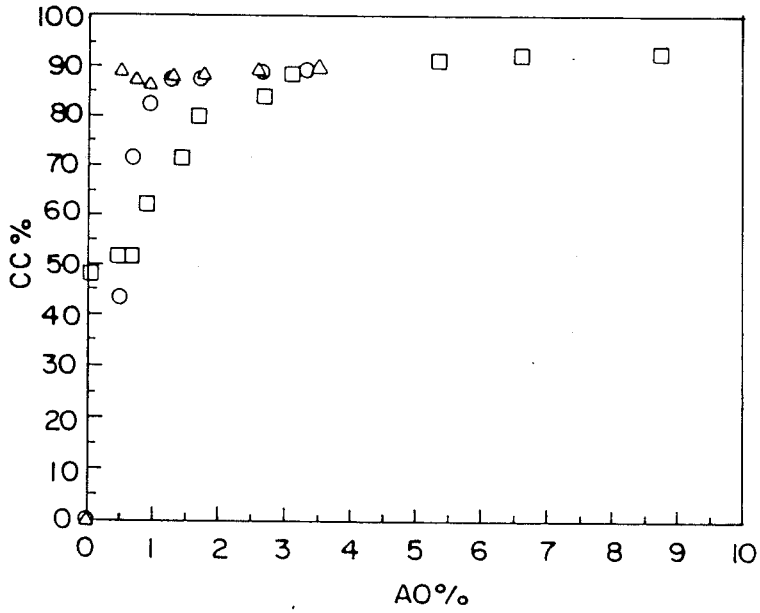
Figure 3:
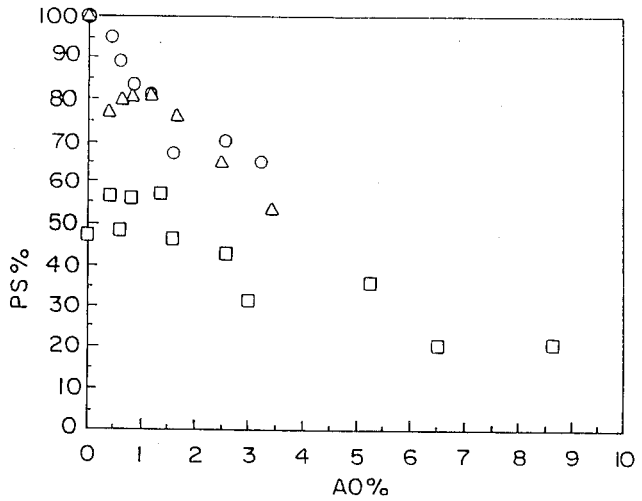
Figure 5:
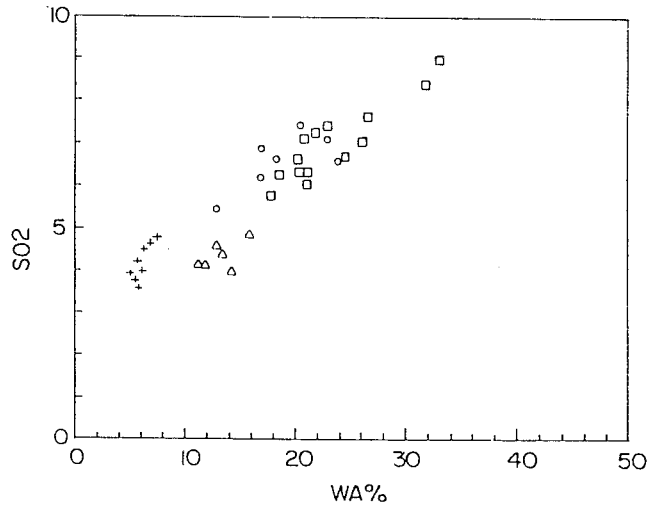
Figure 4:
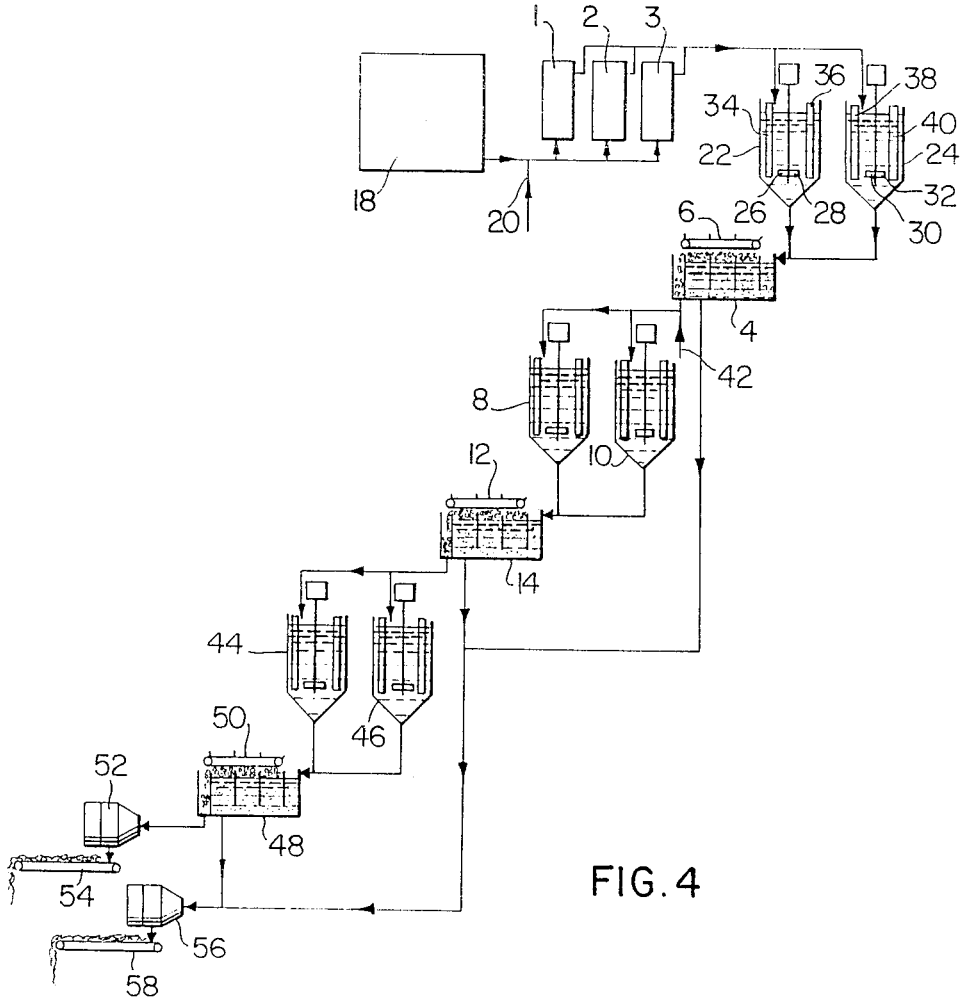

In the accompanying drawings which illustrate, by way of example, embodiments of the present invention, FIG. 1 is a photograph of a typical micro-agglomerate containing slurry that was obtained in tests that were carried out to verify the present invention, FIG. 2 is a graph of results from the tests showing the wt % of carbonaceous coal (CC %) recovered, based on the carbonaceous content of the original slurry, plotted against the wt % of agglomerating oil (AO %) used, based on the total solids content of the original slurry, FIG. 3 is a graph of results from the tests showing the wt % of pyritic sulphur (PS %) separated, of that present in the original slurry, plotted against the same wt % of agglomerating oil (AO %) given in FIG. 2, FIG. 4 is a flow diagram of an apparatus for removing pyritic sulphur from carbonaceous coal, and FIG. 5 is a graph of test results, using an apparatus generally of the type shown in FIG. 4, wherein the equivalent lbs. of sulphur dioxide in the treated coal that would be generated on burning the coal, based on the thermal value of the coal content ($SO_2$) is plotted against the wt% ash present (WA%) in the micro-agglomerates.

In tests to verify the present invention a coal slurry of coal fines from Prince Mine, Cape Breton Island, Nova Scotia, Canada, was used. The coal slurry was taken from the feed to a conventional flotation recovery circuit in use at the mine and consequently had a high pyritic sulphur content. The coal slurry also had a high clay content, which normally affects both froth flotation and oil agglomeration, and does not respond favourably to froth flotation. The agglomerating oil used was No. 4 fuel oil.

In these tests, a laboratory blender was used to mix the slurry with different amounts of agglomerating oil and form micro-agglomerates. Initially the laboratory blender mixed the slurry and the agglomerating oil at high speed for 30 seconds followed by 2 minutes of lower speed mixing for agglomerate growth.

FIG. 1 is a photograph of a typical slurry containing micro-agglomerates that was obtained by the tests. The micro-agglomerates of the slurry shown in FIG. 1 are clearly open structured, chain-like micro-agglomerates.

The slurries obtained were treated in different ways to remove the micro-agglomerates from them, and the removed micro-agglomerates were washed and analyzed for the wt% carbonaceous coal content (CC%) and the wt % pyritic sulphur separated from them (PS %) in relation to the wt % of agglomerating oil (AO %) used based on the total solids content of the slurry.

In FIG. 2, the test results for the wt % carbonaceous coal content obtained in the micro-agglomerates (CC %), based on the carbonaceous content of the original slurry, are plotted graphically against the wt % of agglomerating oil (AO %) used.

In FIG. 3, the test results for the wt % pyritic sulphur separated from the micro-agglomerates are plotted graphically against the wt % of agglomerating oil (AO %) used. In both of the FIGS. 2 and 3, □ represents screening the micro-agglomerates from the slurry and then washing them with water, O represents aerating the slurry to render the micro-agglomerates buoyant, skimming the buoyant micro-agglomerates from the surface of the slurry and then washing them with water to remove trapped water, containing minor amounts of pyritic sulphur and other inorganic solids, from the micro-agglomerates, and Δ represents the same treatment as that designated O except that a frothing agent marketed under the trademark "Aerofroth" by Cyanamid Canada Ltd., Montreal, Canada, was mixed with the slurry before the micro-agglomerates were formed. The amount of frothing agent added was about 0.05 wt % of the total weight of the solids.

In all cases the skimmed micro-agglomerates were broken down and reformed in washing water by mixing them with the washing water to remove trapped water, containing minor amounts of pyritic sulphur and other inorganic solids from the micro-agglomerates, and then separating the washed micro-agglomerates by aeration/skimming them from the washing water containing minor amounts of pyritic sulphur and other inorganic solids.

It will be seen from the FIGS. 2 and 3 that using the screen recovery represented by□, required the addition of about 4 wt % agglomerating oil, in order to obtain washed micro-agglomerates with a high carbonaceous content (CC %) yield. Under these conditions, as shown in FIG. 3 the pyritic sulphur (PS %) separated from the micro-agglomerates is less than 40 wt %. In contrast, when less than about 3 wt % agglomerating oil was used and the aeration/skimmed micro-agglomerates recovered were washed as represented by O or Δ, in accordance with the present invention, a negligible loss in the carbonaceous content (CC %) is incurred while the separation of pyritic sulphur (PS %) dramatically increased to at least about 70 wt %.

FIGS. 2 and 3 also show that even better results are consistently obtained, by the processes designated O or Δ, when less than about 1.5 wt % of agglomerating oil was used in that at least about 88% micro-agglomerates carbonaceous content was obtained with a pyritic sulphur separation (PS %) consistently of at least about 80%. Better still, if the frother is added in the process designated Δ, the amount of agglomerating oil can be reduced to less than about 1 wt % and a micro-agglomerate content (CC %) of at least about 88 wt % consistently obtained with at least about 80 wt % pyritic sulphur separation (PS %) consistently obtained. More recent tests have shown that similar results can be consistently obtained with the frothing agent being added to the slurry in amount in the range of about 0.0025 to 0.5 wt % of the total solids content of the slurry, before the micro-agglomerates are formed, aeration/skimmed and washed. Consistently obtained means that the results are not only repeatedly obtained for more or less identical tests, but under suitable conditions, can consistently be obtained for other coals.

These results are surprising in view of the high clay content of the slurry.

The test results suggested that although pyritic sulphur tends to be hydrophobic and have an affinity for the agglomerating oil in the same manner as carbonaceous coal, the hydrophobicity and affinity for oil of the pyritic sulphur are weaker than they are for carbonaceous coal. Thus by adding less than the conventional amount of agglomerating oil, based on the total weight of the solids content of the slurry, the system is starved of agglomerating oil to such an extent that only sufficient is present to preferentially be adsorbed by the carbonaceous coal and to form micro-agglomerates therewith. The amount of agglomerating oil added being sufficient only for the formulation of micro-agglomerates. Thus a major portion of the pyritic sulphur present in the slurry remains in the form of discrete particles which are separable in two steps from the micro-agglomerates, (i) by the aeration/skimming separation of the micro-agglomerates from relatively larger particles of the pyritic sulphur in the slurry, followed by, ii) washing to separate the micro-agglomerates from releasing relatively smaller particles of the pyritic sulphur that are trapped with water in the micro-agglomerates, and aeration skimming the washed micro-agglomerates from the washing water and the relatively smaller particles of pyritic sulphur.

While it is true as a general statement to say that the amount of agglomerating oil added should be related to the coal particle size, it should be borne in mind that, in practice, the actual amount of agglomerating oil that is added depends on the type of oil used and the type and condition of the coal being treated. Furthermore, relating the amount of agglomerating oil to the coal particle size is not the only parameter which determines whether micro-agglomerates are formed because this, among other things needs to be adjusted depending on the nature of the coal surface (for example, has it been oxidized or not), the compatibility of the type of oil used with the type of carbonaceous coal being agglomerated, the magnitude of, and the time for, the violent mixing that is used. Thus the amount of agglomerating oil used in any particular test will not necessarily be the same as that required for another test.

No. 2 fuel oil has also been used with good results in similar tests to those given above.

Turning now to FIG. 4, there is shown a flow diagram of a large scale method of removing pyritic sulphur from carbonaceous coal.

In FIG. 4 there is shown a method of removing carbonaceous particles, essentially free of pyritic sulphur, from an aqueous coal slurry, comprising:

(a) violently mixing, in a first mixing means comprising high shear mixers 1 to 3, an agglomerating oil with the coal slurry, the coal slurry comprising discrete carbonaceous coal particles, surface conditioning agent additive free discrete particles of pyritic sulphur, discrete particles of any other inorganic substances present, and water, the agglomerating oil being mixed in an amount varying from 0.5 wt % (dry basis), when the coal particles have an average particle size of about 100 microns, to about 10 wt % (dry basis), when the coal particles have an average particle size of about 4 microns, so that only sufficient agglomerating oil is present to preferentially oil wet substantially all of the carbonaceous coal particles, leaving substantially all of the particles of pyritic sulphur unwetted by the agglomerating oil, then (b) continuing the violent mixing in the high shear mixers 1 to 3 until open structured, chain-like micro-agglomerates are formed, in a major portion of the water, comprising essentially oil wetted carbonaceous coal particles, with trapped water in the micro-agglomerates, the trapped water containing minor amounts of the particulate pyritic sulphur and other inorganic substances in finely divided form, with major amounts of the particulate pyritic sulphur and other inorganic substances remaining as individual particles in the major portion of the water !n a relatively coarser form, then (c) aerating the slurry in an aeration tank 4 to render the micro-agglomerates buoyant in the major portion of the water, then (d) separating the buoyant micro-agglomerates by a skimmer belt 6 from the major portion of the water, then, without any additional agglomerating oil being present, (e) removing, as will be described below, trapped water, containing minor amounts of pyritic sulphur and other inorganic substances from the micro-agglomerates.

The trapped water, containing minor amounts of pyritic sulphur and other inorganic solids, is removed from the micro-agglomerates by (f) mixing washing water, in two relatively low shear mixers 8 and 10, with the micro-agglomerates until
  (i) the micro-agglomerates are broken down to disperse the oil wetted carbonaceous coal particles and release the trapped water containing minor amounts of particulate pyritic sulphur and other inorganic substances into the washing water, and
  (ii) the oil wetted carbonaceous coal particles are formed into fresh micro-agglomerates with previously trapped water containing minor amounts of particulate pyritic sulphur and other inorganic substances remaining in the washing water, then (g) aerating, in an aeration tank 14, the washing water to render the fresh micro-agglomerates buoyant, and then (h) separating, by means of a skimmer belt 12, the fresh micro-agglomerates from the washing water.

The aqueous slurry of coal is fed from a supply 18 where any reagents such as frothers or conditioners are added, if required while the agglomerating oil is fed along a feed line 20.

The high shear mixers 1 to 3 are preferably of the type described and claimed in U.S. Pat. No. 4,610,547, dated Sept. 9, 1986, "Apparatus For Dispersing A Particulate Material In A Liquid", Bennett et al, wherein, as shown in that patent, the slurry passes upwardly through a cylindrical container passed a lower, flat impeller blade type turbine rotor, an intermediate knife impeller blade type turbine rotor and an upper pitched impeller blade type turbine rotor. As previously stated, micro-agglomerates of carbonaceous coal particle are agglomerated from the coal slurry in the relatively high shear, impeller blades 1 to 3.

In this embodiment the micro-agglomerates, water and pyritic sulphur together with any other inorganic impurities originally present in the coal slurry are passed to two relatively low shear, impeller blade mixers 22 and 24 each having four, radial flow, flat impeller blades, two of which are shown and designated 26, 28 and 30 and 32, respectively. The relatively low shear, impeller blade mixers 22 and 24 are each provided with four baffles, two of which are shown for each mixer 22 and 24 and designated 34, 36 and 38 and 40, respectively. The baffles, such as those designated 34, 36 and 38, 40, reduce any flow around the impeller blade shaft, caused by the flat impeller blades such as those designated 26, 28 and 30 and 32, of the micro-agglomerates, water and pyritic sulphur together with any other inorganic impurities present so that the predominant flow is radially outwardly from the impeller blades such as those designated 26, 28 and 30, and 32, and then inwardly rebounding along curved paths over and under the impeller blades, such as those designated 26, 28 and 30 and 32, generally towards a central point between them. The baffles such as those designated 34, 36 and 38, 40 are spaced from the containers in which they are situated to avoid the formation of stagnant areas between the baffles, such as those designated 34, 36 and 38 and 40 and their respective containers.

The relatively low shear mixers 12 and 14 promote growth of fresh open structured, chain-like micro-agglomerates and help to release pyritic sulphur particles and other inorganic impurities present together with water.

The micro-agglomerates that are skimmed by a skimmer belt 6 are passed, together with washing water along feed line 42, to the two relatively low shear impeller blade mixers 8 and 10, which are similar to the low speed mixers 22 and 24, where the micro-agglomerates are washed to separate weakly attached pyritic sulphur from them and produce a dense slurry of washed micro-agglomerates with newly released pyritic sulphur separated therefrom.

The washed micro-agglomerates are separated from the newly released pyritic sulphur, any other newly released inorganics and washing water by the aeration tank 14 and skimmer belt 12.

Preferably the washed micro-agglomerates that are skimmed by the skimmer belt 12 are passed to two relatively low shear impeller blade mixers 44 and 46, which are similar to the low speed mixers 8, 10, 22 and 24, where the washed micro-agglomerates are broken-down with additional agglomerating oil and formed into an aqueous slurry containing relatively larger agglomerates. This has the advantage that further water is separated from the carbonaceous material. A balling disc, paddle mixer, or other means of size enlargement, may be used in place of the low speed mixers 44 and 46.

The aqueous slurry is then passed to an aeration tank 48 where the relatively larger agglomerates are aerated and rendered buoyant, and then skimmed from the water by skimmer belt 50.

The relatively larger agglomerates are passed from the aeration tank 48 to a separator, in this embodiment a screen bowl type separator 52, to be dewatered and then deposited on a conveyor belt 54 for storage or further treatment.

The separated water from the aeration tanks 4, 14 and 48, containing pyritic sulphur together with any other inorganic impurities originally present in the coal, is passed to a separator, in this embodiment a solid bowl separator 56, where the inorganic impurities are dewatered and passed to a conveyor 58 for disposal.

In further tests to verify the present invention, using a pilot plant generally described with reference to FIG. 4, a thickened, aqueous mixture of coal fines, from a coal washing plant located in Union County, Ky., U.S.A., was processed. The aqueous mixture of coal fines had an initial equivalent sulphur content of 10 lbs of sulphur dioxide per million B.T.U.'s, and contained 50 wt % of ash on a dry basis.

The results of these tests are shown graphically in FIG. 5, where the total sulphur content of the washed micro-agglomerates, in terms of the equivalent lbs of sulphur dioxide ($SO_2$), that would be generated on burning the coal, per million B.T.U.'s is plotted against the weight % ash (WA %), dry basis, present in the washed agglomerates.

In FIG. 5,

□ represents screened micro-agglomerates which were washed and screened once more, Δ represents micro-agglomerates which were aerated and skimmed by means of a skimmer belt, but were not washed, and + represents micro-agglomerates which were aerated and skimmed by means of a skimmer belt, and then washed and recovered according to the present invention.

It will be seen that using the present invention there was a dramatic reduction in the sulphur content of the micro-agglomerates as well as a dramatic reduction in the ash content.

The micro-agglomerates produced in the tests, using an apparatus generally of the type shown in FIG. 4, were open structured, chain-like micro-agglomerates of the type shown in FIG. 1.

In co-pending Canadian patent Application No. 543,310, filed July 29, 1987, "A Method of Separating Carbonaceous Coal From An Aqueous Coal Slurry", Capes et al, there is described a process comprising first agglomerating carbonaceous coal with agglomerating oil to form open structured, chain-like, micro-agglomerates and then form relatively larger, less open structured more robust agglomerates to provide a mixture of both types of agglomerates. The relatively larger agglomerates may be screen separated while the micro-agglomerates are rendered buoyant by aeration and then skimmed from the water and inorganic particles. In the tests carried out for this process, about 5 or 8 wt % agglomerating oil was used based on the total weight of the solids content of the slurry, and, as shown in the FIGS. 2 and 3, the addition of only 4 wt % agglomerating oil is sufficient to reduce the pyritic sulphur to less than 40%. From this it will be seen that this Capes et al process will not give a high separation of pyritic sulphur.

What is claimed is:

1. A process for removing carbonaceous particles, essentially free of pyritic sulphur, from an aqueous coal slurry, comprising the steps of:

(a) violently mixing an agglomerating oil with a coal slurry which comprises discrete carbonaceous coal particles, surface conditioning agent additive free discrete particles of pyritic sulphur, discrete particles of other inorganic substances, and water, the agglomerating oil being mixed in an amount varying from about 0.5 wt % (dry basis), when the coal particles have an average particle size of about 100 microns, to about 10 wt % (dry basis), when the coal particles have an average particle size of about 4 microns, and wherein the amount of agglomerating oil is such that only sufficient agglomerating oil is present to preferentially oil wet substantially all of the carbonaceous coal particles, and wherein the amount of agglomerating oil is such that substantially all of the particles of pyritic sulphur are unwetted by the agglomerating oil, then (b) continuing the violent mixing until open structured, chain-like micro-agglomerates are formed in a major portion of the water and the micro-agglomerates comprise oil wetted carbonaceous coal particles, and trapped water containing minor amounts of the particulate pyritic sulphur and other inorganic substances in finely divided form, and wherein major amounts of the particulate pyritic sulphur and other inorganic substances remain as individual particles in the major portion of the water in a relatively coarser form, then (c) aerating the slurry to render the micro-agglomerates buoyant in the major portion of the water, then (d) separating and recovering the buoyant micro-agglomerates from the major portion of the water, then (e) removing the trapped water, containing minor amounts of pyritic sulphur and other inorganic substances, from the recovered micro-agglomerates by;

(f) mixing washing water with the recovered micro-agglomerates until (i) the micro-agglomerates are broken down to disperse the oil wetted carbonaceous coal particles and release the trapped water containing minor amounts of particulate pyritic sulphur and other inorganic substances into the washing water, and (ii) the oil wetted carbonaceous coal particles are formed into fresh micro-agglomerates wherein the trapped water containing minor amounts of particulate pyritic sulphur and other inorganic substances substantially remains in the washing water, then (g) aerating the washing water to render the fresh micro-agglomerates buoyant, and then (h) separating the fresh micro-agglomerates from the washing water; and and wherein no additional agglomerating oil is added to the process in steps (b) through (h).

2. A method according to claim 1, wherein, without any additional agglomerating oil being present, steps (f) to (h) are repeated at least once more in fresh washing water to form fresh micro-agglomerates separated from the fresh washing water and newly released, previously trapped pyritic sulphur and any other inorganic substances dispersed in the washing water.

3. A method according to claim 1, wherein after step (h) the fresh micro-agglomerates are broken down and contacted with further agglomerating oil to release water from them, the oil wetted carbonaceous coal particles are then agitated to form relatively larger agglomerates with the further agglomerating oil without released water being present in the relatively larger agglomerates.

* * * * *